United States Patent [19]

Van den Sype et al.

[11] 4,161,415

[45] Jul. 17, 1979

[54] METHOD FOR PROVIDING STRONG WIRE

[75] Inventors: Jaak S. Van den Sype, Scarsdale; Lanier Stambaugh, Briarcliff Manor, both of N.Y.

[73] Assignee: Union Carbide Corporation, New York, N.Y.

[21] Appl. No.: 902,567

[22] Filed: May 3, 1978

Related U.S. Application Data

[63] Continuation-in-part of Ser. No. 874,326, Feb. 1, 1978, abandoned.

[51] Int. Cl.[2] ..... C21D 6/04; C21D 9/52

[52] U.S. Cl. ..... 148/12 B; 148/12 E; 148/12.3; 148/12.4; 148/125

[58] Field of Search ..... 148/12 B, 12 E, 12.3, 148/12.4, 125

[56] References Cited

U.S. PATENT DOCUMENTS

| | | | |
|---|---|---|---|
| 3,871,925 | 3/1975 | Nunes | 148/12.4 |
| 3,920,490 | 11/1975 | Koppenaal et al. | 148/12.4 |
| 4,042,421 | 8/1977 | Van den Sype et al. | 148/12.4 |
| 4,042,423 | 8/1977 | Van den Sype et al. | 148/12.4 |

OTHER PUBLICATIONS

Kalugin, V. O. et al; "Effect of Stress on Phase Transformations in Stainless Steel Wire"; Translation from Metallovedenie I Termicheskaya Obrabotka Metallor; vol. 19, No. 4, 1977, pp. 326–328.

*Primary Examiner*—W. Stallard

*Attorney, Agent, or Firm*—Saul R. Bresch

[57] ABSTRACT

A process for improving the strength characteristics of a wire composed of an austenitic metal alloy selected from the group consisting of stainless steel alloys of the AISI 200 and 300 series and non-stainless steel alloys containing iron, manganese, chromium, and carbon, said alloy having an Md temperature of no higher than about 100° C. and an Ms temperature of no higher than about minus 100° C., comprising the following steps:

(a) deforming the wire at a strain of at least about 10 percent and at a temperature in the range of about Md minus 50° C. to about Md plus 50° C., said Md temperature being that of the alloy undergoing deformation, in such a manner that the wire has a martensite phase of no greater than about 10 percent by volume and an austenite phase of at least about 90 percent by volume and a yield strength in the range of about 130,000 psi to about 230,000 psi;

(b) cooling the wire to a temperature no higher than about minus 75° C.; and (c) drawing the cooled wire through a die under back-tension (i) wherein the back-tension on said wire just prior to the entry of the wire into the die is at least about 75,000 psi and (ii) whereby the cross-sectional area of the wire is reduced by a percentage in the range of about 7 percent to about 25 percent, in such a manner that the wire has a martensite phase of at least about 50 percent by volume and an austenite phase of at least about 10 percent by volume.

9 Claims, 1 Drawing Figure

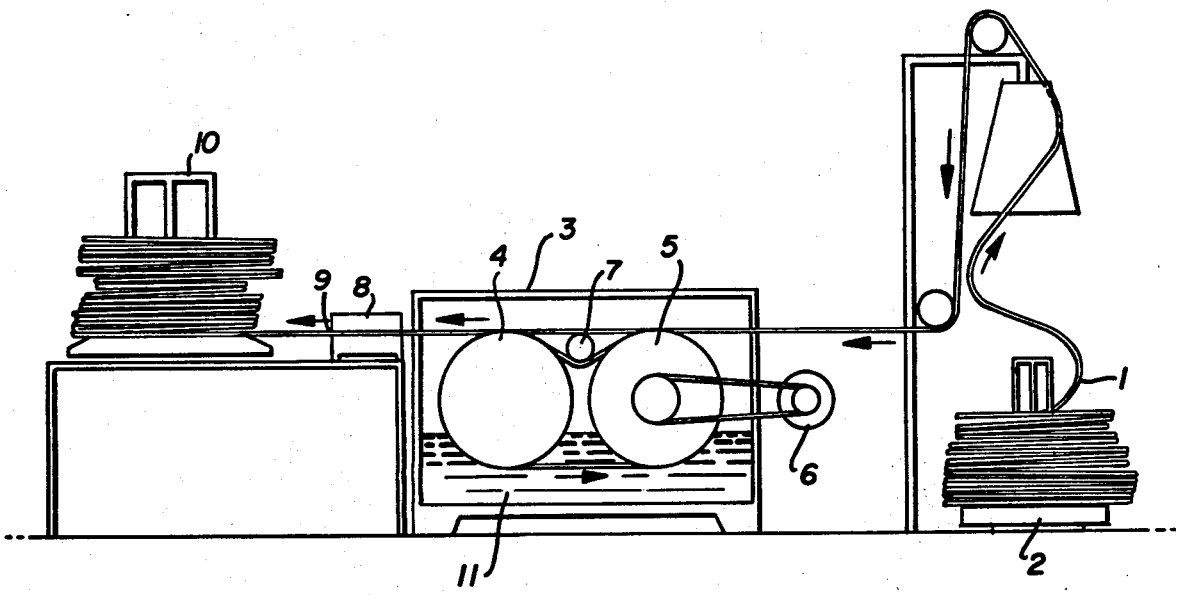
10
9
8
4
3
7
5
6
1
2
11

METHOD FOR PROVIDING STRONG WIRE

This application is a continuation-in-part of application Ser. No. 874,326 filed on Feb. 1, 1978, and now abandoned.

FIELD OF THE INVENTION

This invention relates to a process for improving the strength of wire, and, more particularly, to improving the tensile strength and the torsional yield strength characteristics of certain wire.

DESCRIPTION OF THE PRIOR ART

The chemical compositions of the metal alloys to which this invention is directed are well known and include those alloys listed in the "Steel Products Manual: Stainless and Heat Resisting Steels" published by the American Iron and Steel Institute (AISI) now of Washington, D.C. in 1974 and designated as austenitic with the further proviso that these alloys at least initially have an Md temperature of no higher than about 100° C. (i.e., plus 100° C.) and an Ms temperature no higher than minus 100° C. It will be apparent that the AISI Series Designation 200 and 300 are of interest here. Other alloys contemplated here, again, must be austenitic and have the stated Md and Ms temperatures. These alloys include certain manganese-substituted non-stainless alloys containing iron, manganese, chromium, and carbon exemplified by those designated by DIN (Deutsche Industrie Norme) specifications X40 Mn Cr 18 and X40 Mn Cr 22 and described on pages 655 and 656 of the Metallic Materials Specification Handbook published By E & FN Spon Ltd. London 1972.

The term "austenitic" involves the crystalline microstructure of the alloy, which is referred to as austenitic or austenite when at least about 95 percent by volume of the microstructure has a face-centered cubic structure. Such alloys can be referred to as being essentially or substantially in the austenitic phase. It is understood that the alloys of concern here are essentially in the austenitic or austenite phase at the temperature at which the first deformation step is carried out regardless of the work or temperature previously applied, e.g., the metal or alloy subjected to the first deformation step may have been previously annealed yet it is essentially austenitic when the first step is applied.

The other microstructure with which we are concerned here is a body-centered cubic structure and is referred to as martensitic or martensite. When at least about 95 percent by volume of the structure is martensitic, the alloy is considered to be essentially or substantially in the martensite phase.

The microstructure can, of course, contain both an austenite phase and a martensite phase and the processing to be discussed here both in terms of the prior art and the present invention is one of transformation of at least part of the austenite to martensite thus changing the microstructure of the alloy treated.

The Md temperature is defined as the temperature above which no martensitic transformation will take place regardless of the amount of mechanical deformation which is applied to the metal or alloy and can be determined by a simple and conventional tensile test carried out at various temperatures.

The Ms temperature is defined as the temperature at which martensitic transformation begins to take place spontaneously, i.e., without the application of mechanical deformation. The Ms temperature can also be determined by conventional tests.

Some examples of Md temperatures are as follows:

| AISI stainless steel type no. | Md temperature (°C.) |
|---|---|
| 301 | 43 |
| 302 | 13 |
| 304 | 15 |
| 304L | 18 |

The 301, 302, 304 and 304L steels have Ms temperatures below minus 196° C.

As noted, the deformation referred to is a mechanical deformation and takes place in the range of plastic deformation, which follows the range of elastic deformation. It is caused by subjecting the material to a stress beyond its elastic limit sufficient to change the shape of all or part of the workpiece.

In U.S. Pat. No. 4,042,421 issued Aug. 16, 1977 to Van den Sype et al for "A Method For Providing Strong Tough Metal Alloys", high strength and toughness as well as high torsional yield strengths in wire are achieved by deformation at ambient temperatures and uniaxial stretching at cryogenic temperatures.

The strength property can readily be determined from a simple uniaxial tensile test as described in ASTM standard method E-8. This method appears in part 10 of the 1975 Annual Book of ASTM Standards published by the American Society for Testing and Materials, Philadelphia, Pa. The results of this test on a material can be summarized by stating the yield strength, tensile strength, and total elongation of the material: (a) the yield strength is the stress at which the material exhibits a specified limiting deviation from the proportionality of stress to strain. In this specification, the limiting deviation is determined by the offset method with a specified 0.2 percent strain; (b) the tensile strength is the maximum tensile stress which the material is capable of sustaining (tensile strength is the ratio of the maximum load during a tension test carried to fracture to the original cross sectional area of the specimen); and (c) the total elongation is the increase in gauge length of a tension test specimen tested to fracture, expressed as a percentage of the original gauge length. It is generally observed that when the yield and tensile strengths of metallic materials are increased through metallurgical processes, the total elongation decreases.

In order for wire to be satisfactory for use in highly stressed structures, it is also important that the wire have adequate resistance to brittle failure (toughness). In this regard, metallurgical investigations have shown that sharp cracks can concentrate the applied stresses to a material manyfold and it was found that the behavior of the material under such stress concentrations at crack tips determine to a large degree whether the material is of a ductile or brittle nature. Fracture toughness of a material is a measure of its resistance to brittle failure in the presence of sharp cracks.

The torsional yield strength of wire can be determined by twisting a finite length of wire over increasing angles and observing when a first permanent angular distortion occurs. A two percent torsional yield strength is defined as the shear stress occurring at the surface of the wire when twisted over an angle sufficient to give rise to a two percent permanent angular offset. A similar definition holds for a five percent torsional yield strength. It is desirable that the torsional yield strength of a wire use for spring applications be as high as possible in relation to the tensile strength of the wire.

Wire applications in which the high strength-toughness-torsional yield strength combination is a prerequisite are exemplified by coil springs such as compression or extension springs.

It was noted in U.S. Pat. No. 4,042,421, mentioned above, that the process combining prestrain and low temperature deformation is an improvement over stretching wire at low temperatures, which, in its own right, has the advantages of (i) providing a higher tensile strength, independent from wire diameter, than drawing at low temperatures where the tensile strength is intimately related to the diameter, i.e., the greater the diameter, the lower the tensile strength; (ii) improved torsional yield strength; and (iii) eliminating the need for lubricants.

Stretching is defined as a deformation of workpieces in which one dimension, called the longitudinal direction, is much larger than the two other dimensions, e.g., wire. This deformation comprises applying forces in the longitudinal direction so that essentially the entire cross-section of the workpiece is under uniform uniaxial tensile stress during the deformation. The tensile stresses are of sufficient magnitude to induce permanent plastic deformation in the workpiece, the application of stress being described in terms of percent strain. Since the term "stretching" as used herein is in contradistinction to other deformation processes such as drawing which involves multiaxial states of stress, the term "stretching . . . uniaxially" has been used to further accentuate the difference for as those skilled in the art will recognize the longitudinal elongation of a wire during drawing through a die occurs under the influence of compressive stresses in directions transverse to the drafting direction in addition to the tensile stresses in the drafting or longitudinal direction.

The second step prescribed in a preferred embodiment of the prior art may be considered a non-drawing step to emphasize the importance of uniaxial stretching and exclude the techniques whereby the workpiece is not uniformly strengthened, i.e., where the skin portion is highly strengthened while the core portion is strengthened to a much lesser degree, thus limiting the tensile strength of the drawn wire to that at which the skin portion cracks or ruptures. This deficiency in drawn wire leads to further problems in a specific application, i.e., that of coil springs, where formability is of special interest. In this case, the skin portion has to be sufficiently ductile to withstand wrapping without fracture about an arbor with a diameter at least equal to the diameter of the wire, but, unfortunately the preferential work-hardening of the skin during drawing causes the skin to become more brittle and less ductile thus reducing formability.

The low temperature stretching process is shown to have improved tensile strength and formability as well as torsional and fatigue properties. The prestrain step improves even further on the tensile strength and toughness of the wire thus further upgrading these materials for commercial use.

It has been found, however, that cryogenic stretching has several practical limitations.

For example, in order to produce wire with a 2 percent torsional yield strength of 145,000 psi (1000 Mpa), it is necessary to stretch the wire at cryogenic temperatures by a sufficient amount so as to obtain a wire with an ambient temperature tensile strength before aging of 250,000 psi (1,723 Mpa) or higher. For AISI 302 stainless steel this requires a stress on the wire during the stretching operation equal to about 90 percent of the breaking strength of the wire. This stress imbues the stretching process with the following disadvantages: (i) Frequent fractures occur at surface imperfections and inclusions. Scrap rates are high unless strict controls are maintained over surface quality and cleanliness of starting material. (ii) Strict control must also be exercised over starting material chemistry and grain size in order to optimize the uniform strain capability of the material in tension. (iii) Welds cannot generally be stretched. (iv) The diameter of the wire produced by cryogenic stretching is not sufficiently constant to be used directly in spring applications. In order to produce lubricated wire of constant diameter for spring applications, the cryostretched material must be subsequently sized through a die at room temperature with a reduction in area between 4 and 10 percent. Although this drawing step increases the tensile strength of the wire, it does not improve the torsional yield strength.

The above-enumerated disadvantages lead to high production costs for spring wire made by prestrain and cryogenic stretching.

It is clear from the foregoing that there is a need for a process which can provide wire for spring applications having the strength-toughness-torsional yield strength combination provided by the known two step prestrain and cryostretching process and yet essentially eliminates the disadvantages of cryostretching.

SUMMARY OF THE INVENTION

An object of this invention, therefore, is to provide an improvement in known wire cryodeformation processes whereby high strength, toughness, and torsional yield strength are attained while minimizing fracture, optimizing uniform strain capability, producing constant diameter wires, and eliminating sizing.

Other objects and advantages will become apparent hereinafter.

According to the present invention, a process has been discovered by which the desired high strength-toughness-torsional yield strength combination is achieved with the attendant elimination of the disadvantages inherent in prior art cryostretching and cryodrawing of wire. In this process, a wire composed of an austenitic metal alloy selected from the group consisting of stainless steel alloys of the AISI 200 and 300 series and nonstainless steel alloys containing iron, manganese, chromium, and carbon, said alloy having an Md temperature of no higher than about 100° C. and an Ms temperature of no higher than about minus 100° C., undergoes the following steps:

(a) deforming the wire at a strain of at least about 10 percent and at a temperature in the range of about Md minus 50° C. to about Md plus 50° C., said Md temperature being that of the alloy undergoing deformation, in such a manner that the wire has a martensite phase of no greater than about 10 percent by volume and an austenite phase of at least about 90 percent by volume and a yield strength in the range of about 130,000 psi to about 230,000 psi;

(b) cooling the wire to a temperature no higher than about minus 75° C.; and (c) drawing the cooled wire through a die under back-tension (i) wherein the back-tension on said wire just prior to the entry of the wire into the die is at least about 75,000 psi and (ii) whereby the cross-sectional area of the wire is reduced by a percentage in the range of about 7 percent to about 25 percent;

in such a manner that the wire has a martensite phase of at least about 50 percent by volume and an austenite phase of at least about 10 percent by volume.

The strain applied in step (a) will on occasion be referred to in this specification as "prestrain".

Final optimization of the strength properties is achieved by subjecting the wire to conventional aging at a temperature in the range of about 350° C. to about 450° C.

BRIEF DESCRIPTION OF THE DRAWING

The sole FIGURE of the drawing is a schematic diagram illustrating the side view of apparatus, which can be used to carry out the drawing step referred to above.

DESCRIPTION OF THE PREFERRED EMBODIMENT

The alloys to which the process is applied are described above and, as noted, are conventional. The only prerequisites are that when the first deformation step is applied they meet the definition of austenitic, and their Md temperatures are no higher than about 100° C. and their Ms temperatures are no higher than about minus 100° C.

AISI series 300 alloys are preferred, particularly AISI 302 containing C, Ni, Cr, and Mn. For spring wire applications, it is suggested that 302 alloy be used and that certain components of the 302 alloy fall within the following ranges (in weight percent): nickel 8.0 to 9.0; chromium 17.5 to 19.0; carbon 0.085 to 0.115; manganese less than 1; silicon 0.2 to 0.5; nitrogen 0.02 to 0.08; molybdenum, less than 0.6; sulphur, less than 0.01; and phosphorous, less than 0.035. It is desirable to minimize inclusions.

The deformation is mechanical and takes place in that region known as the region of plastic deformation.

The mechanical deformation techniques which can be used both in the first and second deformation steps, steps (a) and (c), again are conventional as well the apparatus availed of to carry out these techniques.

The deformations must, of course, be sufficient to provide the stated percentages of martensite and austenite, which are first determined by conventional analytical techniques such as X-ray diffraction or magnetic measurements and then on the basis of the experience of the operator with the various alloys on deformation in the noted temperature ranges. To more accurately define the deformation in step (a), it has been set forth in terms of strain. Although the strain occurring during process deformation is usually more complex than those occurring during a simple tension test, it is found that for the materials to which the invention applies, the strengthening effects that occur during complex deformations can be evaluated from the observed strengthening effects during a simple tension test using the principle of "equivalent uniaxial" strain or "effective" strain as set forth, e.g., in "Mechanical Metallurgy" By G. E. Dieter, Jr., published by McGraw-Hill Book Company (1961), on page 66.

Where a deformation step is performed by drawing through a die, the amount of deformation is conventionally described by the reduction in cross-sectional area of the wire after it passes through the die. This area reduction (RA) is related to the equivalent uniaxial strain (E) by the formula:

$$E=RA/1-RA$$

The minimum strain in step (a) deformation is at least about 10 percent. There is no upper limit for percent strain except that of practicality in that at a certain point the change in microstructure and strength-toughness properties become minimal and, of course, there is a limit as to fracture of the material. In any case the suggested strain range in this first step is from about 10 to about 80 percent and, preferably, about 20 to about 60 percent.

As pointed out, the initial alloy utilized in the process is at least about 95 percent by volume austenite, the balance being martensite. Under deformation in step (a) (or prestrain), the alloy may be changed slightly from a microstructural point of view so that 0 to about 10 percent by volume is in the martensite phase and about 90 to about 100 percent by volume is in the austenite phase, and there is, preferably, 0 to about 5 percent by volume martensite and about 95 to about 100 percent by volume austenite.

The prestrain step is conducted at a temperature in the range of about Md minus 50° C. to about Md plus 50° C., preferably about Md minus 10° C. to about Md plus 10° C., said Md temperature being that of the alloy undergoing deformation, e.g., where the Md temperature is 43° C., Md minus 50° C. will equal minus 7° C. and Md plus 50° C. will equal 93° C. Step (a) may be accomplished by drawing or stretching. The alloys under consideration here are considered stable, i.e., austenitically stable, at these first step temperatures even though they undergo the changes set forth above when subjected to deformation.

In addition to providing a strain in step (a) which will give the requisite martensite-austenite content, the strain is further adjusted to provide yield strengths in the range of about 130,000 to about 230,000 psi. These particular yield strengths are obtained first by testing samples of the wire and then through the experience of the operator with the particular wire undergoing treatment, the temperature at which the step (a) deformation is undertaken, and the amount of strain used, the latter amount of strain usually being adjusted to accommodate the particular wire and temperature. Preferred yield strengths obtained by prestrain are in the range of about 130,000 psi to about 180,000 psi. It is suggested that prior processing such as annealing and prestrain be optimized to achieve a small grain size.

In step (b), the wire is cooled to a temperature no higher than about minus 75° C. and, preferably, less than about minus 100° C. These temperatures can be achieved by immersing the wire in liquid nitrogen (B.P. minus 196° C.); liquid oxygen (B.P. minus 183° C.); liquid argon (B.P. minus 186° C.); liquid neon (B.P. minus 246° C.); liquid hydrogen (B.P. minus 252° C.); or liquid helium (B.P. minus 269° C.). Liquid nitrogen is preferred. A mixture of dry ice and methanol, ethanol, or acetone has a boiling point of about minus 79° C. and can also be used; however, the lower temperatures are preferred since, as is well known, the lower the temperature, the lower the amount of strain needed for each percent of improvement in tensile strength. As will be seen hereinafter, the cooling step, step (b), must take place prior to drawing step (c) provided that the wire enters the die at substantially the temperature to which it has been cooled in step (b). This means that steps (b) and (c) should be so coordinated that the time interval between the two steps is short enough to substantially avoid any temperature rise above the cooling temperature of step (b).

Step (c) is similar to step (a) insofar as deformation or strain is concerned, however, the deformation is defined in different terms. In any case, sufficient strain must be applied to provide the stated percentages of martensite and austensite, first determined by conventional analysis and then by reliance on operator experience. The minimum strain applied in the second deformation is at least about 10 percent. Here, also, there is no upper limit for percent strain except the bounds of practicality in that change in microstructure and strength-toughness properties tend to become minimal and there is a limit due to fracture of the material. The suggested strain range is about 10 to about 60 percent and is, preferably, about 20 to about 40 percent.

In step (c), the required strain is provided by drawing the cooled wire through a die under back-tension (i) wherein the back-tension on said wire just prior to the entry of the wire into the die is at least about 75,000 psi and (ii) whereby the cross-sectional area of the wire is reduced by a percentage in the range of about 7 percent to about 25 percent. Again, conventional analysis can be used to determine that the correct martensite-austenite values are achieved.

The dies which may be used in this step are conventional, e.g., tungsten carbide drawing dies. The cone angle of the carbide nib is found to be optimally about 12 degrees. Larger die angles give rise to an excessive amount of redundant work of deformation resulting in less than optimum properties. Die angles smaller than 12 degrees have too large a bearing length and the increased friction between die and metal is also found to provide less than optimum properties particularly with respect to torsional yield.

The lubricants used for the wire and which are applied prior to drawing are also conventional. Typically, prior to step (b), the wire is precoated with lubricant. This precoat is applied by dipping the coils in standard precoat solutions. These solutions may contain lime or oxalate. Prior to entering the die in step (c), and after step (b), the wire passes through a box filled with a dry soap such as calcium stearate soap. To enhance, its passage through the die, the wire may also be copper-coated.

The drawing speed is fast enough to move the cooled wire through the lubricant and to the entrance of the die aperture before the temperature of the wire rises substantially above the cooling temperature of step (b).

It will be understood that once the wire is in the die, the work of deformation, the exothermic reaction of transforming austenite to martensite, and the friction may raise the temperature of the wire as much as about 200° C. where the wire was initially at liquid nitrogen temperature. This adiabatic heating heating effect aids the performance of the conventional lubricants. Generally, the drawing speed is about 100 to about 800 feet per minute for wire diameters of about 0.04 inch to about 0.2 inch. The stated drawing speeds refer to the outgoing wire diameter, i.e., the diameter of the wire as it leaves the die. The drawing speed will be slower for larger diameter wire and faster for wire of thinner diameter, the most desirable speed being determined by the experience of the operator with the particular wire.

The term "back-tension" is defined as the stress in the longitudinal direction on the wire prior to entering the die. Stated back-tensions refer to the incoming wire diameter, i.e., the diameter of the wire as it enters the die. It is also referred to as "back-pull." Back-pull wire drawing is well-known and is discussed in the Journal of the Iron and Steel Institute, November, 1947, at pages 417 to 428 and in the Steel wire Handbook, Volume 1, published by the Wire Association, Inc., Stamford, Connecticut, 1965, at pages 245 to 250. The preferred amount of back-tension is in the range of about 75,000 psi (517 Mpa) to about 150,000 psi (1,034 Mpa). The smoothest operation occurs with higher back-tension.

The preferred reduction in cross-sectional area of the wire is in the range of about 15 to about 25 percent.

Again, determination of the martensite-austenite content is first made by conventional analytical techniques with adjustment of parameters and then by operator experience with the same materials.

In step (c), the microstructure of the metal or alloy is changed appreciably so that at least 50 percent by volume is in the martensite phase and at least 10 percent by volume is in the austenite phase. The preferred range lies in the area of about 60 to about 90 percent by volume martensite and about 10 to about 40 percent by volume austenite. It is believed that the high austenite content contributes to the toughness of the processed material.

At all times in this specification the microstructure of the initial alloy and of the products of the prestrain, cryodrawing, and aging is considered to consist essentially of austenite and/or martensite in the percentages previously stated. Any other phases present are not of interest here since such phases, if they are present at all, are less than about one percent by volume and have little or no effect on the properties of the alloy.

It is noted that the ranges, in which the strain percentages for step (a) and step (c) lie, overlap. Although the percentages can be the same, it is preferred that the ratio of prestrain to drawing strain is in the range of about 1:1 to about 3:1.

After step (c), the alloy is preferably subjected to aging to optimize strength. Aging is carried out in a conventional manner at a temperature in the range of about 350° C. to about 450° C. and, preferably, in the range of about 375° C. to about 425° C. Aging time can range from about 30 minutes to about 10 hours and is preferably in the range of about 30 minutes to about 2.5 hours. Conventional testing is used here to determine the temperature and time, which give the highest strength properties.

It will be noted, that aging tends to improve yield strength even more than tensile strength, and, for the alloy to reach the highest strength levels, can be carried to a point where yield strength approximates the tensile strength.

Ratios of torsional yield strength to tensile strength, after aging, are found to be in the range of about 0.45 to about 0.49 when subject process is carried out in the preferred manner.

The following examples illustrate the invention:

EXAMPLES 1 to 3

The wire in all examples contains at least 95 percent by volume austenite prior to the first deformation and at least 90 percent by volume austenite prior to the drawing step. After the drawing step, the wire contains at least 50 percent by volume martensite and at least 10 percent by volume austenite. Percent by volume martensite is determined by quantitative X-ray diffraction technique. The balance (to make up a total of 100 percent) is considered to be austenite. Other phases are not more than one percent by volume and are not considered here.

Annealed AISI type 302 stainless steel wire is used. The annealing is accomplished with conventional techniques by heating the wire between 980° C. and 1150° C. followed by rapid cooling.

The examples are carried out by following the steps described above, the cooling and drawing steps, steps (b) and (c), being carried out in the apparatus shown in the sole figure of the drawing. Yield strength, tensile strength, and torsional yield strength are determined as described above in the body of the specification.

Referring to the drawing, the wire 1, having been coated with a conventional lubricant precoat, is wound off spool 2 into double capstan cooler 3 (an insulated metal dewar) containing liquid nitrogen 4 where it first passes around capstan 4 and then around capstan 5, moving in the direction of the arrows. Each capstan contains twenty grooves and wire 1 is wrapped around both capstans twenty times, the wire, of course, being in the grooves. This procedure cools wire 1 to minus 196° C. Back-tension is applied by means of brake 6 connected to capstan 5 (back-tension is not applied to welds made after the first deformation). The wire then passes from capstan 5 to single grooved roller 7 where back-tension is measured by means of a strain gauge (not shown) after which the wire exits cooler 3. Moisture build-up on the cooled wire is avoided by use of a nitrogen shroud. After leaving cooler 3, wire 1 enters die box 8 (a pressure die is preferably used here to enhance lubrication), which is filled with soap (a conventional lubricant) and is drawn through die 9 having an approach angle of 12 degrees. The drawing force is generated by means of conventional bull-block 10. Die 9 and die-box 8 are not immersed in liquid nitrogen, but the travel time between cooler 3 and die 9 is sufficiently short that no appreciable heating occurs.

The tensile strength is determined after the drawing step and then the wire is aged in a conventional manner at 400° C. for ½ hour in a Lindberg Model 59744 furnace in air. The surface oxidation of the wire occurring during ageing is assumed not to effect the resulting mechanical properties. The temperature along the length of all specimens does not vary more than ±10° C. from the preset temperature.

The wire of all of the examples shows adequate formability in that it can be wrapped around an arbor equal to the final wire diameter without fracture.

After ageing, the torsional yield strength is determined.

The chemical composition of the alloys used in the examples is as follows:

| | Example 1 | Examples 2 and 3 |
|---|---|---|
| Cr | 18.7 | 17.7 |
| Ni | 8.18 | 8.13 |
| Mn | 0.49 | 0.91 |
| C | 0.102 | 0.105 |
| S | 0.004 | 0.002 |
| Mo | 0.17 | 0.54 |
| Cu | 0.19 | 0.28 |
| N | 0.072 | 0.04 |
| Co | 0.09 | 0.23 |
| Si | 0.42 | 0.47 |
| P | 0 | 0.03 |
| Fe | balance | balance |

Other variables and results are in the Table.

Table

| | Example 1 | | Example 2 | | | Example 3 | |
|---|---|---|---|---|---|---|---|
| | Sample 1 | Sample 2 | Sample 1 | Sample 2 | Sample 3 | Sample 1 | Sample 2 |
| initial wire diameter - inch | 0.114 | | 0.085 | | | 0.156 | |
| type of prestrain | stretching* | | drawing* | | | drawing* | |
| prestrain temperature - °C. | 21 | | 21 | | | 21 | |
| After prestrain: | | | | | | | |
| (i) wire diameter - inch | 0.096 | | 0.071 | | | 0.130 | |
| (ii) reduction of area - % | 28 | | 30.0 | | | 30.6 | |
| (iii) yield strength - ksi | 169 | | 160.0 | | | 152.2 | |
| (Mpa) | (1,166) | | (1,103) | | | (1,049) | |
| (iv) tensile strength - ksi | 174 | | 162.2 | | | 160.5 | |
| (Mpa) | (1,200) | | (1,119) | | | (1,106) | |
| die size and final wire diameter - inch | 0.087 | | 0.062 | | | 0.115 | |
| drawing speed - feet per minute | 34 | 100 | 350 | | | 120 | |
| back tension -ksi | 97 | 138 | 60 | 88 | 129 | 36 | 113 |
| (Mpa) | (668) | (951) | (414) | (607) | (890) | (298) | (779) |
| after drawing: | | | | | | | |
| (i) reduction in area - % | 17.5 | | 23.8 | | | 21.7 | |
| (ii) tensile strength - ksi | 283 | | 282 | 285 | 288 | 272 | |
| (Mpa) | (1950) | | (1945) | (1965) | (1986) | (1874) | |
| after ageing: | | | | | | | |
| (i) 2% torsional yield strength -ksi | 144 | 166 | 147 | 150 | 162 | 142 | 149 |
| (Mpa) | (992) | (1,144) | (1014) | (1034) | (1117) | (978) | 1,027) |

ksi = 100 psi (pounds per square inch)
Mpa = megapascal
*conventional
Note: where one number appears in the column under Example, such number is the same for all Samples.

I claim:

1. A process for improving the strength characteristics of a wire composed of an austenitic metal alloy selected from the group consisting of stainless steel alloys of the AISI 200 and 300 series and non-stainless steel alloys containing iron, manganese, chromium, and carbon, said alloy having an Md temperature of no higher than about 100° C. and an Ms temperature of no higher than about minus 100° C., comprising the following steps:

(a) deforming the wire at a strain of at least about 10 percent and at a temperature in the range of about Md minus 50° C. to about Md plus 50° C., said Md temperature being that of the alloy undergoing deformation, in such a manner that the wire has a martensite phase of no greater than about 10 percent by volume and an austenite phase of at least about 90 percent by volume and a yield strength in the range of about 130,000 psi to about 230,000 psi;

(b) cooling the wire to a temperature no higher than about minus 75° C.; and (c) drawing the cooled wire through a die under back-tension (i) wherein the back-tension on said wire just prior to the entry of the wire into the die is at least about 75,000 psi; and (ii) whereby the cross-sectional area of the wire is reduced by a percentage in the range of about 7 percent to about 25 percent;

in such a manner that the wire has a martensite phase of at least about 50 percent by volume and an austenite phase of at least about 10 percent by volume.

2. The process defined in claim 1 comprising the following additional step:

(d) ageing the material produced in step (c) at a temperature in the range of about 350° C. to about 450° C.

3. The process defined in claim 2 wherein, in step (a), the strain is about 10 to about 80 percent and the yield strength is in the range of about 130,000 psi to about 180,000 psi and, in step (c), the back-tension is in the range of about 75,000 psi to about 150,000 psi and the cross-sectional area of the wire is reduced by a percentage in the range of about 15 percent to about 25 percent.

4. The process defined in claim 3 wherein the strain in step (a) is provided by stretching.

5. The process defined in claim 3 wherein the strain in step (a) is provided by drawing.

6. The process defined in claim 2 wherein the material is a stainless steel alloy of the AISI 300 series.

7. The process defined in claim 3 wherein the material is a stainless steel alloy of the AISI 300 series.

8. The process defined in claim 4 wherein the material is a stainless steel alloy of the AISI 300 series.

9. The process defined in claim 5 wherein the material is a stainless steel alloy of the AISI 300 series.

* * * * *